US008418901B2

(12) United States Patent
Stimmell

(10) Patent No.: US 8,418,901 B2
(45) Date of Patent: Apr. 16, 2013

(54) RAPID DEPLOYMENT AMMUNITION CARRIER APPARATUS AND METHOD

(76) Inventor: James S. Stimmell, Cocoa, FL (US)

( * ) Notice: Subject to any disclaimer, the term of this patent is extended or adjusted under 35 U.S.C. 154(b) by 583 days.

(21) Appl. No.: 12/387,883

(22) Filed: May 11, 2009

(65) Prior Publication Data

US 2010/0282804 A1 Nov. 11, 2010

(51) Int. Cl.
*B60R 11/00* (2006.01)
*F42B 39/02* (2006.01)

(52) U.S. Cl.
USPC ..... 224/275; 224/583; 224/585; 224/623; 224/648; 224/931

(58) Field of Classification Search ..... 224/583–585, 224/275, 605–606, 616, 623, 638, 647–649, 224/236, 914, 931; 190/110; 206/3
See application file for complete search history.

(56) References Cited

U.S. PATENT DOCUMENTS

| | | | | | |
|---|---|---|---|---|---|
| 119,400 | A * | 9/1871 | Penrose | 224/148.6 |
| 182,695 | A * | 9/1876 | Oliver | 224/639 |
| 756,177 | A * | 3/1904 | Mills | 224/682 |
| 1,520,962 | A | 12/1924 | North | |
| 1,969,258 | A * | 8/1934 | Cross | 224/547 |
| 2,853,219 | A | 9/1958 | Schwartz | |
| 3,167,182 | A | 1/1965 | Calvin | |
| 4,024,997 | A * | 5/1977 | Kolpin | 224/584 |
| 4,106,121 | A | 8/1978 | Belson | |
| 4,301,898 | A * | 11/1981 | Plough et al. | 190/102 |
| 4,961,522 | A * | 10/1990 | Weber | 224/585 |
| 5,016,797 | A * | 5/1991 | Rowledge | 224/257 |
| 5,413,199 | A * | 5/1995 | Clement | 190/108 |
| 5,617,582 | A | 4/1997 | Burwell | |
| 5,749,503 | A * | 5/1998 | Wulf et al. | 224/153 |
| 5,829,060 | A | 11/1998 | Falk et al. | |
| 5,950,894 | A * | 9/1999 | Haber | 224/627 |
| 6,119,907 | A | 9/2000 | Benjamin | |
| 6,185,738 | B1 | 2/2001 | Sidebottom | |
| 6,568,575 | B1 * | 5/2003 | Bartholomew | 224/583 |
| 6,968,960 | B1 | 11/2005 | Maliniak | |
| 7,152,247 | B2 | 12/2006 | Parsons | |
| 7,207,469 | B2 | 4/2007 | Hussaini et al. | |
| 2001/0011664 | A1 * | 8/2001 | Meritt | 224/275 |
| 2007/0131568 | A1 * | 6/2007 | Georgia et al. | 206/223 |
| 2007/0228097 | A1 * | 10/2007 | Recanati | 224/580 |

* cited by examiner

*Primary Examiner* — Nathan J Newhouse
*Assistant Examiner* — John Cogill
(74) *Attorney, Agent, or Firm* — William M. Hobby, III

(57) ABSTRACT

A rapid deployment ammunition carrier has a shoulder mounted ammunition belt having a plurality of ammunition pouches and a plurality of body mounting straps. An ammunition belt carrying case is shaped to hold the ammunition belt therein with the body mounting straps positioned for rapid deployment from the carrying case. The carrying case is mounted to a vehicle seat for rapid deployment of the ammunition belt by an occupant of the vehicle.

6 Claims, 5 Drawing Sheets

RAPID DEPLOYMENT AMMUNITION CARRIER APPARATUS AND METHOD

BACKGROUND OF THE INVENTION

The present invention relates to a rapid deployment ammunition carrier apparatus and method and especially to an ammunition belt held in an ammunition belt carrying case strapped to a vehicle seat and positioned for rapid deployment of the ammunition belt from the carrying case by an occupant of the vehicle.

In the past, it has been common to provide an ammunition carriers for use by military and police personnel. These carriers are usually belts or vests which attach to a person, such as a policeman. Ammunition vests and belts typically have ammunition pouches for holding the ammunition and are time consuming to attach to a person especially when responding to emergency situations.

Typical prior art ammunition carrying belts or vests may be seen in the Burwell U.S. Pat. No. 5,617,582 for a load bearing vest employed for military and police usage. This vest attaches over the shoulders and around the waist and is attached by pulling the vest from overhead with the user's arms extending upward to pass through the shoulder straps. The vest includes a plurality of pouches for holding ammunition. The Belson U.S. Pat. No. 4,106,121 is a tactical load bearing vest having a plurality of pouches for carrying ammunition as well as rations, weapons and ancillary supplies on the body of a soldier. The Parsons U.S. Pat. No. 7,152,247 is for a tactical jacket for a police officer and allows a police officer to carry equipment including a gun, radio, handcuffs, a flashlight, as well as extra ammunition. Other ammunition carrier vests and belts may be seen in the Falk et al. U.S. Pat. No. 5,829,060 for a vest including a retractor pocket and retractor therein and the method of manufacturing the vest and in the H. A. North U.S. Pat. No. 1,520,962 for a protective garment and in the Benjamin U.S. Pat. No. 6,119,907 for a shoulder arm gun case convertible to a belt pack. The Sidebottom U.S. Pat. No. 6,185,738 shows a tactical load bearing protective vest.

It has also been known in the past to attach various types of holding assemblies to a vehicle seat. The Hussaini et al. U.S. Pat. No. 7,207,469 is a mounting system for audio visual equipment which mounts to the back of a vehicle seat and includes a strap that fits around the headrest of the vehicle seat. The C. A. Calvin U.S. Pat. No. 3,167,182 is a gun rack for a vehicle in which the gun rack is mounted to the back of a vehicle seat. The H. Schwartz U.S. Pat. No. 2,853,219 shows an umbrella container for automobiles which mounts to the back of a vehicle seat while the Maliniak U.S. Pat. No. 6,968,960 shows a digital video disc holding assembly which mounts to the back of a vehicle seat.

In contrast to the prior body supported ammunition carrier cases, the present invention provides for a rapid deployment ammunition carrier which attaches to the front of the vehicle seat and allows the occupant to open the carrying case with one hand while sliding an arm through an ammunition vest or belt shoulder straps while pulling one shoulder strap over the head to rapidly attach the ammunition carrier to a person's body for rapid deployment by police personnel.

SUMMARY OF THE INVENTION

A rapid deployment ammunition carrier has a shoulder mounted ammunition belt or vest having a plurality of ammunition pouches and a plurality of body mounting straps. The ammunition belt carrying case is shaped to hold the ammunition belt therein with the body mounting straps positioned for rapid deployment from the carrying case. The carrying case has a rapid opening front panel. The carrying case holding the ammunition belt is attached to a vehicle seat for rapid deployment by the vehicle occupant. The rapid deployment ammunition carrier is mounted to a vehicle seat and allows a vehicle occupant to open the front panel thereof and slide the ammunition belt therefrom onto the vehicle occupant. A rapid opening panel has a pair of zippers parallel to each other with the zipper tabs being connected by a strap for simultaneously opening both zippers by pulling on the strap to expose the ammunition belt. The ammunition belt has a plurality of body mounting straps including a pair of shoulder straps positioned in the carrying case for a vehicle occupant to slide one arm through while pulling one of the straps over his head, thereby pulling the ammunition belt from the carrying case. A plurality of body mounting straps also includes a chest strap for attaching around the chest of the user with ammunition. The belt carrying case has a strap attached thereto and sized to fit around a vehicle seat to hold the carrier case to the seat and also has a headrest strap attached thereto for extending around the vehicle head rest. The carrying case is made of a flexible fabric while the ammunition belt has a plurality of connections for adjustably mounting the shoulder straps to the ammunition pouches.

The process of attaching the rapid deployment ammunition carrier to a vehicle occupant includes the steps of selecting a shoulder mounted ammunition belt and carrying case in accordance with the present invention and strapping the carrying case and ammunition belt to a vehicle seat and then opening the rapid opening front panel of the carrying case. One arm of a vehicle occupant is slid through a pair of body shoulder mounting straps while pulling one of the straps over the occupant's head and onto the shoulders of the occupant while pulling the ammunition belt from the carrying case and onto the occupant. The process also includes the step of attaching one of the plurality of straps around the chest of the occupant. The step of opening the carrying case includes pulling on a strap connecting a pair of parallel zippers to open the front panel with one hand in one motion.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
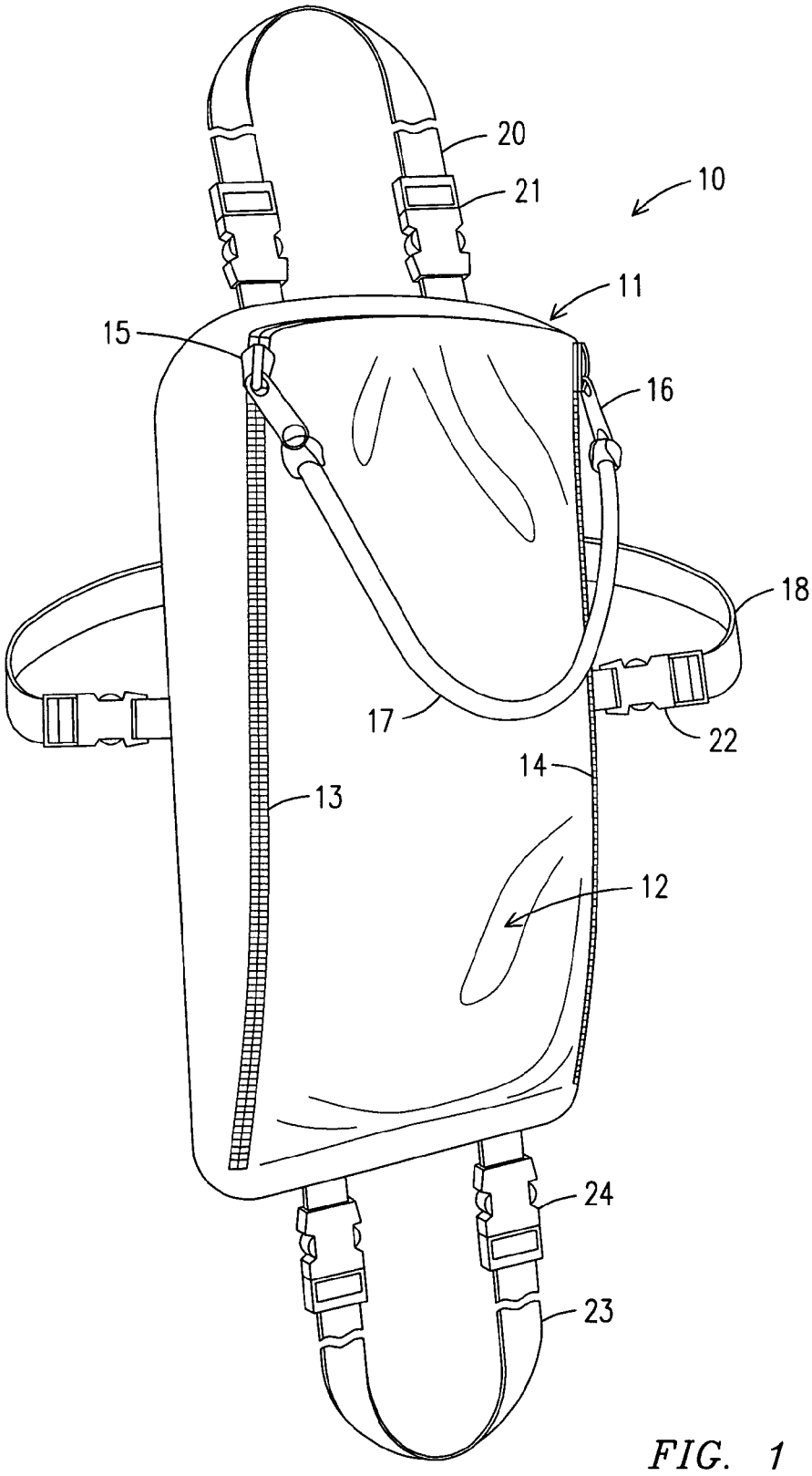
FIG. 1 is a perspective view of a rapid deployment ammunition carrier in accordance with the present invention.

Referring to the drawings and especially to FIG. 1, a rapid deployment ammunition carrier 10 is illustrated having an ammunition belt carrying case 11, which case can be made of a flexible fabric, such as nylon or the like and has a front panel 12 for opening the carrying case. The carrying case has a pair of parallel zippers 13 and 14 for closing the carrying case front panel. Each zipper has an opening slide 15 having a zipper tab 16 attached thereto. An opening strap 17 is attached to each of the zipper tabs 16 to allow both zippers to be opened simultaneously by pulling on the strap 17 to thereby open the front panel 12 in a rapid manner using only one hand. The carrying case 11 is a seat strap 18 for attaching the carrying case 11 to a vehicle seat, as more clearly shown in FIGS. 2, 3, 4 and 5. The carrying case 11 also has a headrest strap 20 held to the case with a pair of clip fasteners 21. The seat strap 18 is also held to the carrying case 11 with a pair of snap clips 22. A seat strap 23 is attached to the bottom of the carrying case 11 with a pair of snap clips 24. The carrying case 11 can be easily attached to a vehicle seat 25, as shown in FIGS. 2 and 3, with the strap 18 attached around the seat and the headrest strap 20 attached around the headrest 26 with the seat straps 23 attached under the seat.

Figure 2:
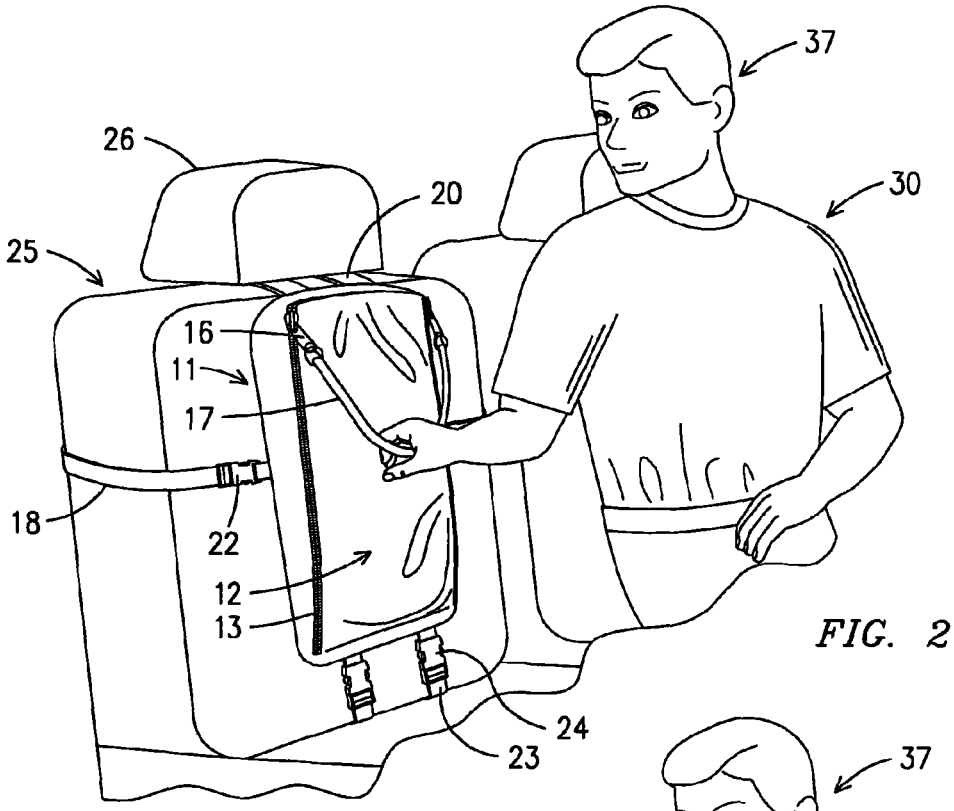
FIG. 2 is a perspective view of the ammunition carrier of FIG. 1 mounted to a vehicle seat having the opening strap grasped by an occupant of the vehicle.
Figure 3:
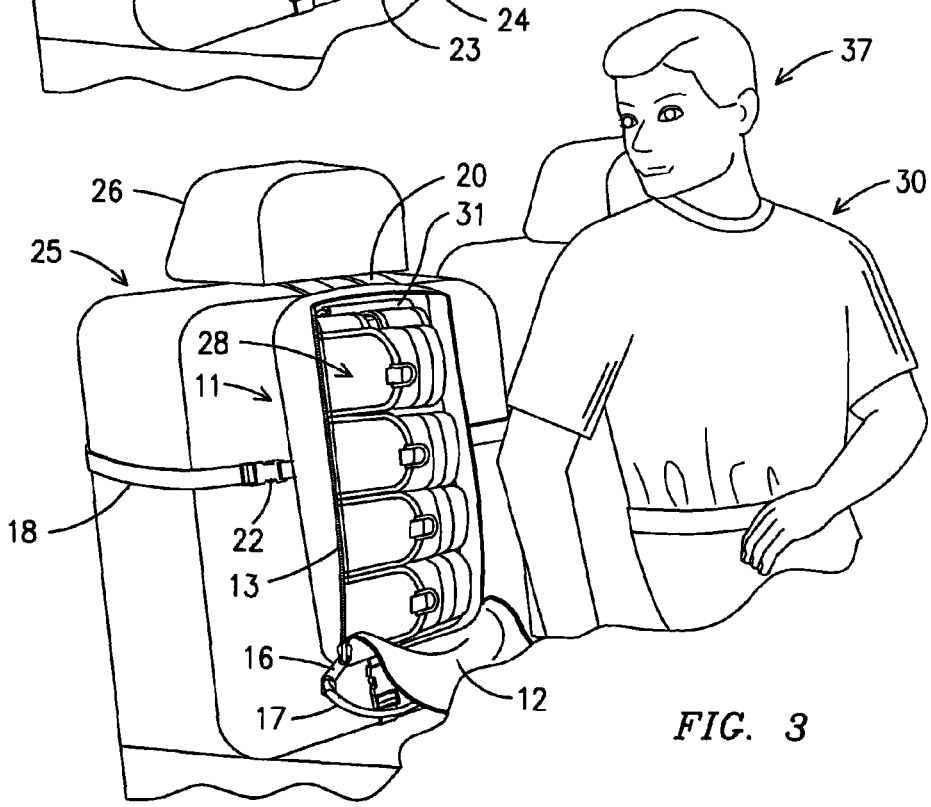
FIG. 3 is a perspective view, as shown in FIG. 2, having the carrying case zipped open.
Figure 9:
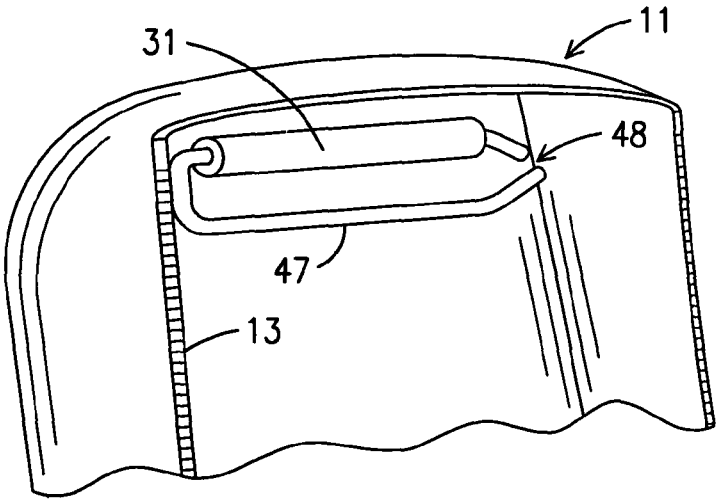
FIG. 9 is a partial perspective of the ammunition belt carrying case showing the inside hanger for the ammunition belt.

FIGS. 2 through 7 illustrate a process of attaching a rapid deployment ammunition carrier 28 to a vehicle occupant 30. In FIG. 2, the occupant 30 is grasping the opening strap 17 to open the carrying case 11. The carrying case 11 has been opened, as shown in FIG. 3, showing the shoulder mounted ammunition belt stowed in the case 11 and hanging from a belt hanger 31 which belt hanger can be more clearly seen in FIG. 9. It should be noted that the reference to a belt also includes a vest. The occupant 30 is thrusting his arm through the shoulder straps 32 and 33 of the ammunition belt 28 in FIG. 4. The ammunition belt 28 has a plurality of ammo carrying pouches 34 supported by the shoulder straps 32 and 33.

Figure 5:
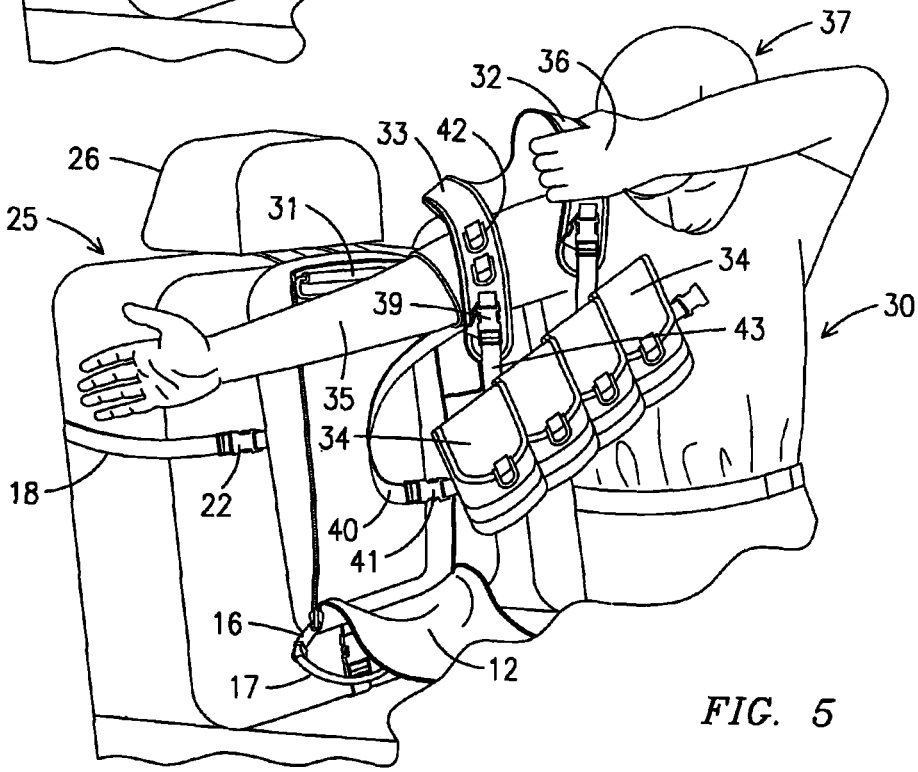
FIG. 5 is a perspective view of the ammunition carrier of FIGS. 1 through 4 having the occupant grasping one of the shoulder straps of the ammunition belt and pulling one shoulder strap over his head.
Figure 6:
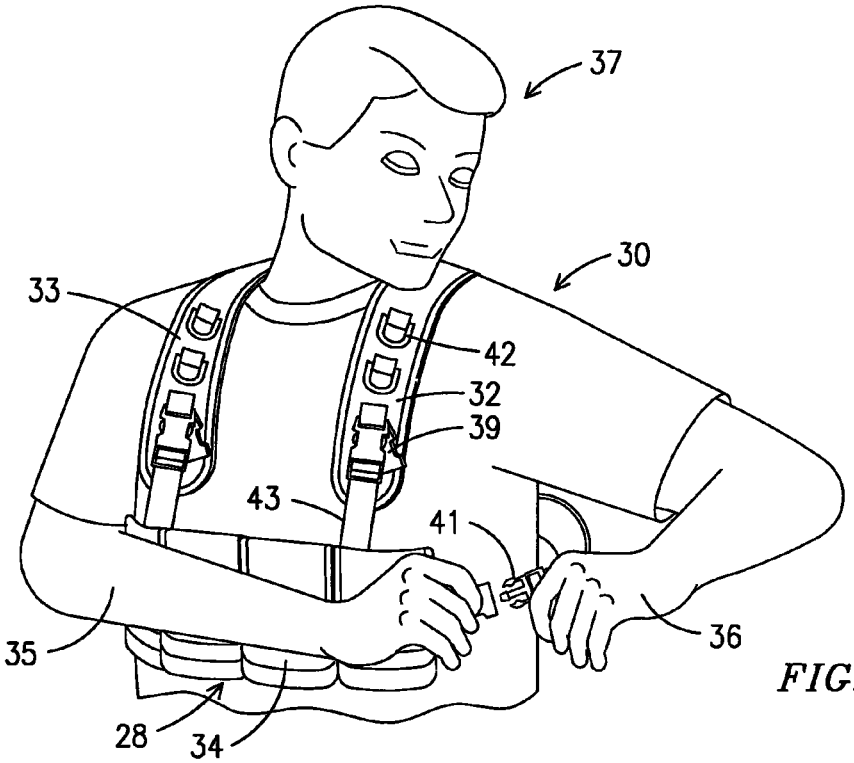
FIG. 6 is a perspective view of the ammunition belt removed from the carrying case and mounted over the shoulder's of the occupant who is attaching the chest strap.

In FIG. 5, the vehicle occupant 30 has his right arm 35 through the shoulder straps 32 and 33 and is grasping the shoulder strap 32 with his hand 36 while pulling the strap over his head 37. This motion pulls the ammunition pouches 34 onto the person 30 with one strap 32 on one side of the person's head resting on the shoulder and strap 33 resting on the shoulder on the other side of the head 37, as seen in FIG. 6. In FIG. 6, the occupant is also using his hands 36 to attach the chest strap or belt 40 with a snap clip 41. This leaves the ammunition belt 28 attached to the user, as shown in FIG. 7.

Figure 7:
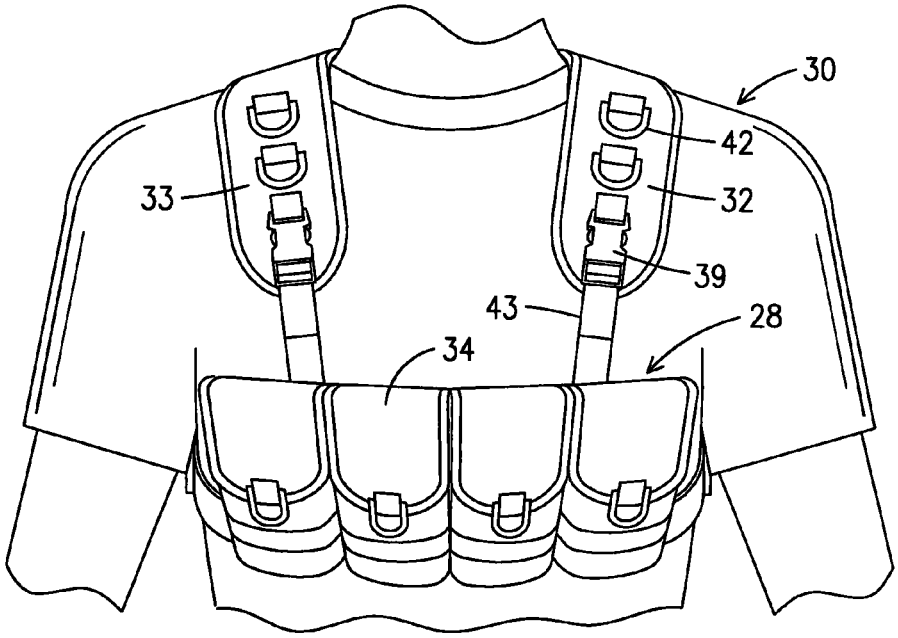
FIG. 7 is a front elevation of the ammunition belt fully deployed for use by the occupant.

As shown in FIGS. 6 and 7, the ammunition belt 28 has a plurality of coupling rings 42, such as D-rings, for attaching other equipment, such as weapon slings, flashlights, knives, hydration systems of drinking tubes and the like. Strap portions 43 may be cinch type straps which can be adjusted by pulling on the end thereof or lengthened by lifting the bight. The straps 43 attach to the buckles 39.

Figure 4:
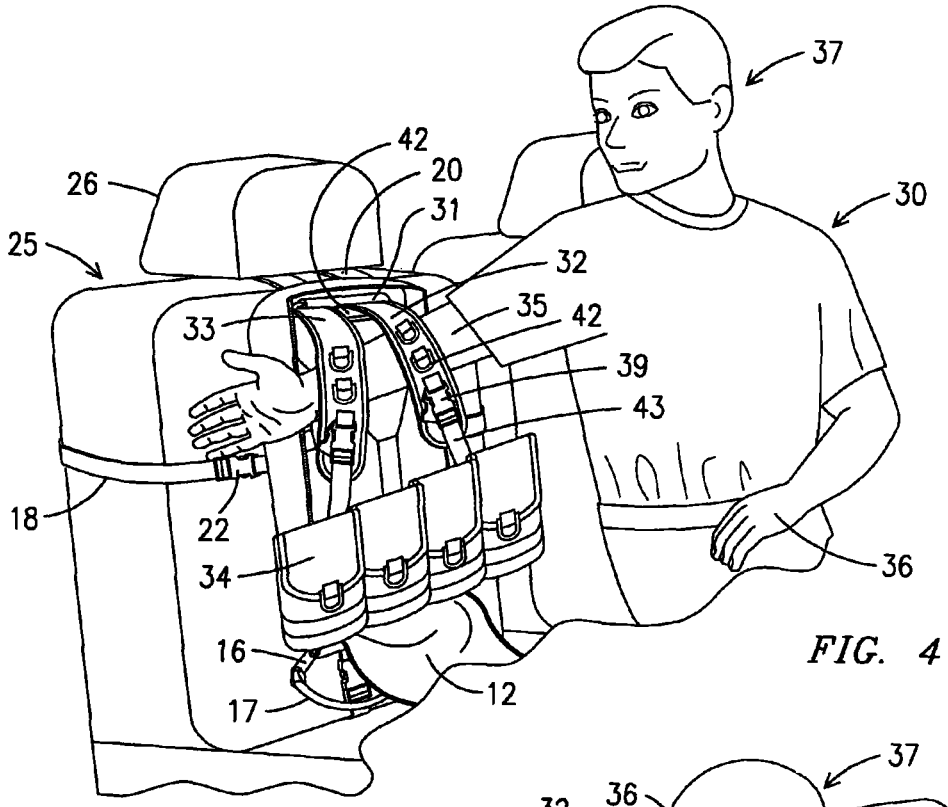
FIG. 4 is a perspective view of the carrying case opened and the vehicle occupant sliding an arm through the shoulder straps of an ammunition carrier.
Figure 8:
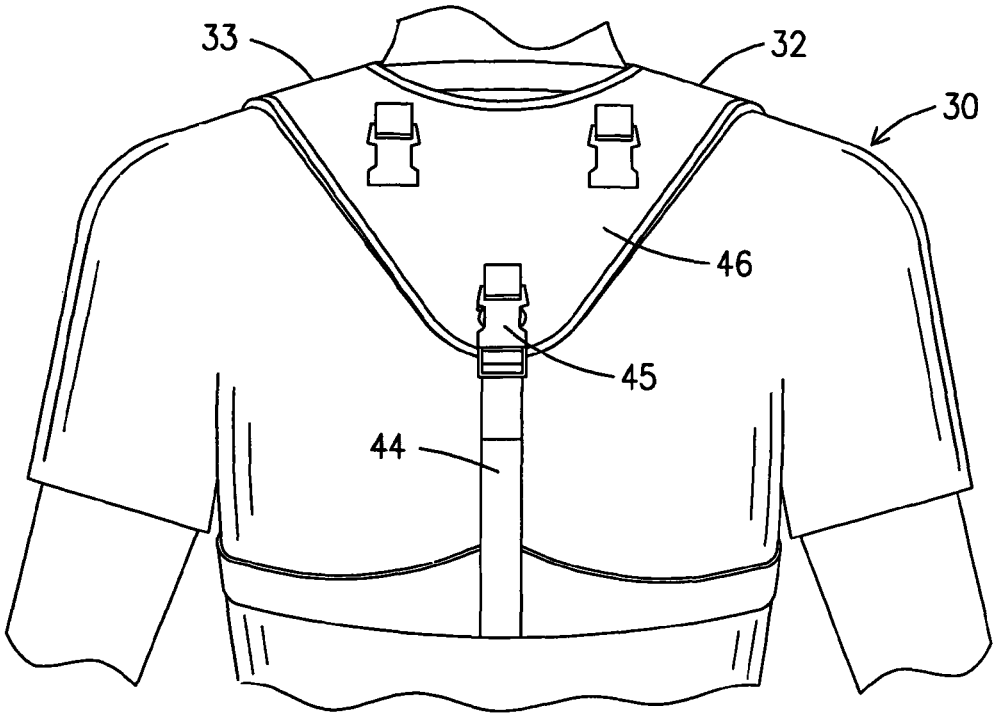
FIG. 8 is a rear elevation of the occupant having the ammunition belt attached.

The rapid deployment ammunition carrier 10 allows for the rapid deployment of the ammunition belt in a smooth continuous motion, as illustrated in FIGS. 2 through 7. The ammunition belt, as shown in FIG. 8, has the back strap 40 extending around the back and also has an additional strap 44 having a snap clip 45 attaching it to the shoulder straps and support 46 which has the straps 32 and 33 connected thereto. The ammunition belt 28 is then placed into the ammunition belt carrying case 11 by folding and placing it in the case 11 with the straps 32 and 33 supported on hanger 31. Hanger 31 is mounted in the upper part of the case 11. The shoulder strap portions 32 and 33 are hung over the strap hanger 47 which has an open end 48 so that the shoulder straps can be instantly deployed, as shown in FIGS. 3, 4 and 5.

It should be clear at this point that a rapid deployment ammunition carrier has been provided which allows a policemen or other occupant of a vehicle to rapidly deploy the ammunition carrier for a quick response as the vehicle occupant is exiting the vehicle. However, the present invention should not be construed as limited to the forms shown which are to be considered illustrative rather than restrictive.

I claim:

1. A rapid deployment ammunition carrier comprising:

a shoulder mounted ammunition belt having a plurality of ammunition pouches and a plurality of body mounting straps;

an ammunition belt carrying case shaped to hold said ammunition belt therein with said plurality of body mounting straps positioned for rapid deployment from said carrying case, said carrying case having an openable front panel having a pair of zippers parallel to each other, each said zipper having a slide tab and said carrying case having a strap connecting to each said zipper tab for simultaneously opening both zippers for the rapid opening of said front panel for the rapid removal of said ammunition belt, said carrying case having a strap hanger mounted therein, wherein one said body mounting strap can be hung thereover;

said ammunition belt plurality of body mounting straps having a pair of shoulder straps positioned in said carrying case for a vehicle occupant to slide one arm through while pulling one said strap over his head while pulling the ammunition belt from the carrying case; and a plurality of vehicle seat mounting members attached to said carrying case for attaching said carrying case holding said ammunition belt to a vehicle seat for rapid deployment by a vehicle occupant;

whereby a rapid deployment ammunition carrier mounted to a vehicle seat allows a vehicle occupant to open the front panel thereof and slide the ammunition belt therefrom onto the occupant.

2. The rapid deployment ammunition carrier in accordance with claim 1 in which said ammunition belt carrying case has a strap attached thereto sized to fit around a vehicle seat to hold said carrying case to said seat.

3. The rapid deployment ammunition carrier in accordance with claim 2 in which said ammunition belt carrying case has a headrest strap attached thereto and extending therefrom for attaching to a vehicle headrest.

4. The rapid deployment ammunition carrier in accordance with claim 3 in which said ammunition belt carrying case is made of a flexible fabric.

5. The rapid deployment ammunition carrier in accordance with claim 1 in which said ammunition belt plurality of body mounting straps includes a chest belt for attaching around the chest of a user.

6. The rapid deployment ammunition carrier in accordance with claim 1 in which each said shoulder strap has a plurality of rings attached thereto for attaching additional equipment thereto.

* * * * *